United States Patent [19]

Stolzer

[11] Patent Number: 4,960,396

[45] Date of Patent: Oct. 2, 1990

[54] FOOT-OPERATED BOAT PADDLE PROPULSION SYSTEM

[76] Inventor: Lawerence Stolzer, 11409 Jamestown Dr., Little Rock, Ark. 72211

[21] Appl. No.: 413,600

[22] Filed: Sep. 28, 1989

Related U.S. Application Data

[63] Continuation-in-part of Ser. No. 145,386, Jan. 19, 1988, abandoned.

[51] Int. Cl.[5] ..... B63H 16/00

[52] U.S. Cl. ..... 440/21; 114/153; 440/13

[58] Field of Search ..... 440/21, 13, 14, 15, 440/65, 24, 27, 28; 114/162, 165, 153

[56] References Cited

U.S. PATENT DOCUMENTS

| | | | |
|---|---|---|---|
| 2,631,559 | 3/1953 | Jones | 114/153 X |
| 3,038,435 | 6/1962 | Fairfax | 440/21 |
| 3,095,850 | 7/1963 | Stolzer | 440/21 |

*Primary Examiner*—Joseph F. Peters, Jr.
*Assistant Examiner*—Edwin L. Swinehart
*Attorney, Agent, or Firm*—Stephen D. Carver

[57] ABSTRACT

A boat-mounted pedal-driven paddle system for maneuvering a lightweight fishing boat. When employed for movement, a paddle is vertically oriented with its blade parallel to the keel of the boat and removably mounted upon the transom by a manually adjustable C-clamp. A pair of cooperating foot pedals are permanently, pivotally mounted upon a crossbar which transverses the width of the boat and is connected between the boat sides. The foot pedals are operatively linked to the paddle system via a pair of flexible cables guided upon a multiplicity of cooperative pulleys and connected to the pedals via a pivotal cable guide donut. Paddle movement involves three basic motions. First, the paddle is rotatable a limited degree about its longitudinal axis, and the position to which it axially rotates determines blade operative pitch during propulsion. Second, the paddle swings in an arc of roughly 180 degrees, which arc lies in a plane generally parallel with and spaced apart from the boat transom to propel the boat in a direction predetermined by the previously established blade pitch. Third, in response, for example, to underwater obstacles, the paddle may be deflected in an arc occupying a plane generally perpendicular to the transom, and generally coplanar with the longitudinal axis of the boat. The paddle may thus assume a generally horizontal, inclined position well above the surface of the water and be suspended in an out-of-the way position for travel or storage.

13 Claims, 4 Drawing Sheets

FOOT-OPERATED BOAT PADDLE PROPULSION SYSTEM

CROSS REFERENCE TO RELATED APPLICATION

This is a Continuation in Part of my prior application entitled Improved Foot Operated Boat Paddle, Filed Jan. 19, 1988, Ser. No. 145,386, Group Art Unit 315, Examiner: E.Swinehart now abandoned.

BACKGROUND OF THE INVENTION

The present invention relates generally to paddle or sculling propulsion systems for fishing boats. More particularly, the present invention relates to an improved foot operated paddle assembly for flat-bottomed fishing boats. It is believed that the invention is properly classified in U.S. class 115, subclass 125.

The present device comprises an improvement of the foot-operated boat paddle invented by my father, F.L. Stolzer, and disclosed in U.S. Pat. No. 3,095,850, issued July 2, 1963, which is hereby incorporated by reference.

As will be appreciated by those skilled in the art, a variety of pedal-driven boat paddle devices exist in the prior art. The propulsion device proposed by d'Elloy, U.S. Pat. No. 4,353,703 (issued Oct. 12, 1982), comprises a pair of cooperating vertically-oriented paddles operatively associated with a pedal mechanism adapted to be attached to a small raft. The mechanical paddle drive includes a pair of guide rudders for manually guiding the craft.

U.S. Pat. No. 3,680,522, issued to Clark on Aug. 1, 1972 generally suggests the desirability of providing a pedal-powered boat drive mechanism with a drive shaft comprising cooperating clutches for propelling the boat in both a forward backward direction.

Other prior art known to me comprises U.S. Pat. Nos. 4,323,352; 4,345,903; 3,467,049; 4,172,426; 4,231,309; 3,056,977; 3,038,435.

None of the prior art devices known to me provides adequately stabilized means for dYnamically securing the paddle assembly to the boat. No adequate means are suggested in the prior art which permit the paddle to smoothly ride over unseen submerged objects, such as tree stumps, fence posts, or the like. Frequently, therefore, the paddle will become damaged, broken, or dislodged from its mount when it strikes such an object. Other prior art pedal-driven paddle devices I have studied do not satisfactorily permit the seated user to conveniently manipulate the paddles to effectuate forward and backward propulsion.

The paddle invention of the previous patent, U.S. Pat. No. 3,095,850, fails to suggest adequate recoil means for limiting tilt of the paddle relative to the boat. The teachings of the patent fail to include any suggestion as to the desirability of providing a mechanism for facilitating automatic return of the paddle to its normally vertical, upright orientation after the paddle recoils. The prior art device disclosed therein forced the user to rise from a seated, driving position and balance upon the hull of the boat to restore the paddle to its operative position after recoil. Moreover, such manual adjustment of the paddle required substantial physical strength. Further disadvantages of the previous device include inadequate stabilization during operation and noise produced during paddling.

SUMMARY OF THE INVENTION

The present invention comprises a foot-operated paddle system which enables a fisherman to manually propel and maneuver a fishing boat in selected directions. A variety of forward, backward, and sideways movements are enabled. The system is semi-permanently mounted upon the hull of a lightweight, flat-bottomed boat. In the best mode the system comprises a rigid paddle dynamically mounted upon the transom and linked to a steering control assembly driven by a pair of cooperating foot pedals.

The system is preferably secured to the hull of a boat by a manually adjustable C-clamp mount. Additional reinforcement to prevent deformation of the lightweight, usually-aluminum boat body is afforded by a rigid mounting plate which is preferably permanently welded to the bow of the boat. An elongated, rotatable cylinder preferably links the mount to the preferred steering assembly. Steering and propulsion are established by foot-driven pedals linked to the paddle through cables.

A pair of cooperating foot pedals are permanently, pivotally suspended upon a rigid, transverse support bar removably mounted between the interior sides of the boat. The pedal support bar provides stability to the assembly during operation and results in virtually silent operation, which is desired to avoid scaring away the fish. The foot pedals are preferably operatively linked to the steering assembly via a pair of flexible cables made of coated nylon or similar material. The cables are guided upon a pair of cooperating pulleys and extend from the pedals to a donut mount. The donut can pivot in a plane generally perpendicular to the transom. A spring exhibiting a predetermined tension yieldably biases the donut away from the transom. The spring may preferably be interchanged with a lighter weight spring, so that the device may be more easily manipulated, for example, by children. A lighter weight spring also facilitates the change from reverse to forward drive.

Turnbuckle mounts associated with the cables permit manual adjustment of the cable length and tension to properly align the paddle and pedal assembly for use. The cables are removably mounted to facilitate convenient replacement or maintenance as needed.

Paddle dynamics involve three basic motions. First, the paddle is rotatable about its longitudinal axis, and the position to which it axially rotates determines its operative pitch. Second, the paddle swings in an arc of roughly 180 degrees, which arc lies in a plane generally parallel with and spaced apart from the boat transom. The last mentioned plane is generally perpendicular to the axis of the boat. By virtue of sweeping arcs struck by each stroke of the paddle through the water, the boat may be silently sculled in a forward or backward direction at a variable speed. The direction of movement will be established by the pitch of the paddle, which changes for each stroke. Third, in response to obstacles, the paddle may be deflected in an arc occupying a plane generally perpendicular to the transom, and generally coplanar with the longitudinal axis of the boat. The paddle may thus assume a generally horizontal, inclined position well above the surface of the water and be suspended in an out-of-the way position for travel or storage.

A cam assembly facilitates tilting of the paddle during the aforementioned third movement along an arc of roughly seventy degrees. The paddle may tilt forward or backward in response to an impact from a submerged tree stump or the like. When a strike is experienced, a travel-limiting follower associated with the cam assembly will become yieldably disengaged from a track defined within the cam body while the paddle tilts. The paddle is automatically urged back into engagement with the cam body and returned to its upright position by the force of water resistance.

In operation, the paddle is normally oriented in a generally upright position with its blade in the water. Peddling sweeps the paddle (i.e. the second above mentioned movement) to propel the boat. The direction of travel is established by blade pitch (i.e. the first above mentioned movement) and pitch is established by blade twisting established by that cable which is most tensioned in a given stroke. However, when the sum of the tensions on each cable leading to the donut is greater than the predetermined spring tension mentioned above, the donut flips over, and now each stroke established by the most tensioned cable will first twist the paddle to a different pitch than before, reversing the direction of boat travel. By thus varying either or both of the difference in tension between cables leading to the donut, and/or the total tension transmitted by cables to the donut, the fisherman may quickly and easily effectuate a change from forward to backward motion.

Additionally, the paddle may be rotated roughly ninety degrees to a horizontal position and thus secured, when it is desired to disengage the assembly entirely. Thus, the assembly may be mounted together with a power motor or hand oars. When the paddle strikes an unseen underwater object such as a tree or post, it will tilt or recoil from its upright position so that it will smoothly "ride over" the obstruction without being broken, damaged, or dislodged from its mounting. After recoil, the paddle may be quickly automatically returned to its upright position by manipulation of the pedals.

Thus it is a broad object of the present invention to provide a pedal-driven paddle system for propelling a boat through the water either forwards or backwards.

Another fundamental object of the present invention is to provide an improved foot-powered boat paddle system of the nature described which is adapted to "ride over" submerged obstacles without sustaining damage or becoming dislodged from its mount.

A similar object is to provide a boat-paddle system which may be conveniently, automatically restored to its upright, operative position after it strikes a submerged object.

A still further object of the present invention is to provide a foot-powered boat paddle of the nature described which includes improved stress joint means to facilitate restoration of the paddle to its original upright operating position after overstress is experienced.

Another object of the present invention is to provide an improved foot-powered boat paddle of the character described which is lighter in weight and more easily installed than known prior art boat paddles.

Yet another object is to provide a boat paddle system of the nature described which may be manually adjusted to compensate for the weight load in the boat.

A further object of the present invention is to provide a boat paddle system which can be easily adapted for operation by different users, including children.

A still further object of the present invention is to provide a boat paddle assembly of the character described which includes improved pedal mounting means for improved stabilization and quiet operation.

Another object of the present invention is to provide a boat paddle assembly of the character described which includes means for manually setting and adjusting the orientation of the paddle relative to the pedals.

Yet another object of the present invention is to provide a boat paddle assembly of the character described which may be easily and conveniently disengaged from operation when not in use and hence may be used as an auxiliary to a power motor or hand oar system.

These and other objects and advantages of the present invention, along with numerous features thereof, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views:

FIG. 5 is an enlarged, exploded, fragmentary sectional view taken generally along line 5—5 of FIG. 4, with portions thereof broken away for clarity or omitted for brevity;

DETAILED DESCRIPTION

Figure 1:
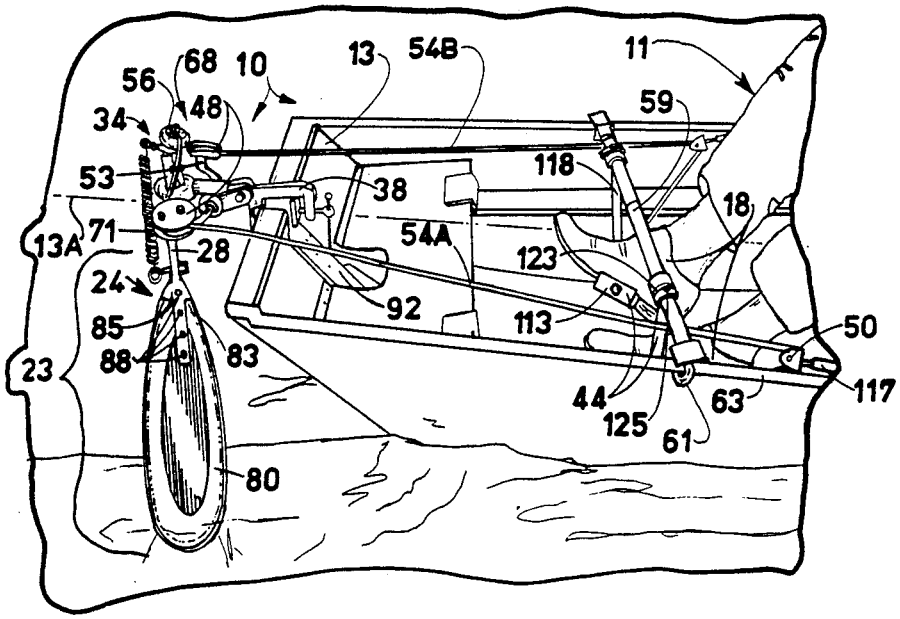
FIG. 1 is a fragmentary, perspective view illustrating the best mode of my FOOT-OPERATED BOAT PADDLE PROPULSION SYSTEM in use upon a typical flat-bottomed fishing boat.

With reference now directed to the appended drawings, the best mode of my improved foot-powered boat paddle assembly is generally designated by the reference numeral 10. The assembly 10 may be mounted upon hull 12, preferably on transom 13, of a fishing boat 15. As described in detail hereinafter, assembly 10 permits the seated fisherman to silently maneuver the boat forwards or backwards through the water while fishing. Assembly 10 is powered and controlled solely by the feet 18 of a fisherman or other operator, so that the fisherman's hands are free during use to manipulate other devices, such as fishing rods and tackle, guns, or other sporting gear. Additionally, the fisherman may selectively elevate the paddle system 24 out of the water to a generally horizontal position when, for example, use of an outboard motor is desired for high-speed travel.

Paddle system 24 responds to cable pressures transmitted from the foot pedals to effectuate three basic motions. As a preliminary matter, the paddle responds to both the total pressure in the control cables, and to the difference in pressure between the cables. All cable pressures result from pedaling. As used herein the term "first motion" refers to limited paddle rotation about its longitudinal axis when one cable overpressures the other, as happens each time one pedal is depressed. Paddle orientation after torsional rotation determines its operative pitch and thus the direction of boat propulsion.

The term "second motion" refers to the swinging of the paddle in an arc of roughly 180 degrees, which arc lies in a plane generally perpendicular to the longitudinal axis 13A of the boat. This second motion, the "power stroke," results when one cable overpressures the other, and it operatively occurs immediately after the paddle first axially rotates in the above first motion in response to differential pressure.

The term "third motion" refers to movement of the paddle in an arc occupying a plane generally coplanar with the longitudinal axis of the boat, and generally perpendicular to the aforementioned second motion plane. The third motion allows the paddle to "give" in response to contact underwater obstacles, and it allows fisherman 11 to move the apparatus to a convenient out-of-the-way storage or transportation position. All three of these motions may operate substantially concurrently, and the hardware to be disclosed enables the different movements to occur in harmony with one another.

Figure 2:
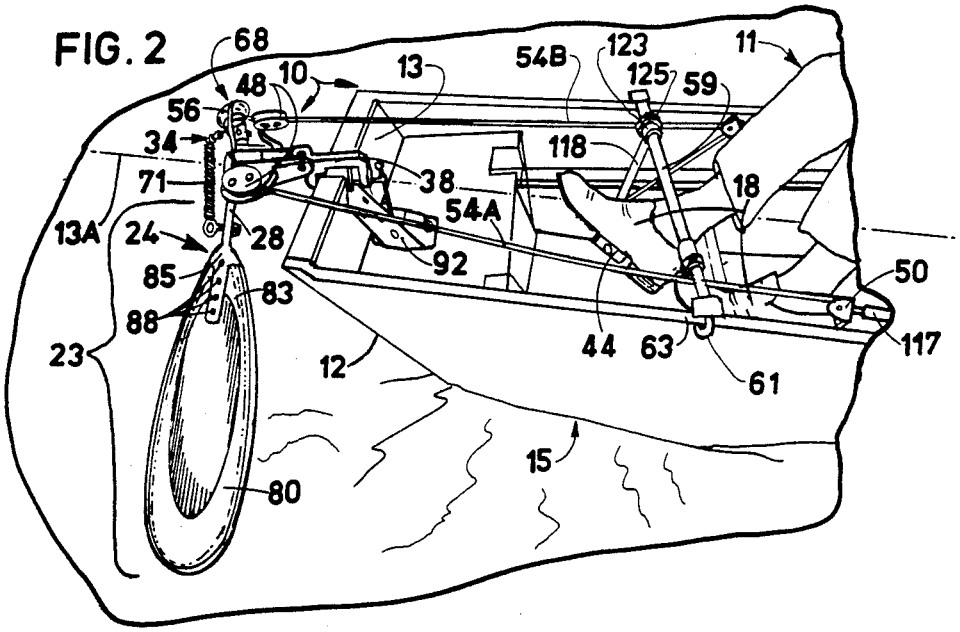
FIG. 2 is a fragmentary perspective view similar to FIG. 1, illustrating the propulsion system with the paddle swung through a propulsion stroke.

With primary reference now directed to FIGS. 1 and 2, assembly 10 preferably comprises an elongated, rigid paddle assembly 24 which moves the boat. It is operatively associated with a mechanical control system, generally designated by the reference numeral 34, which utilizes cables to interconnect the paddle system with foot pedals. The frame of the assembly is operatively, pivotally mounted on transom 13 by an adjustable clamp 38. To prevent the lightweight, aluminum body of the conventional flat-bottomed fishing boat 15 from being damaged or warped as a result of hard impacts or of the constant force of water resistance against the assembly 10, a rigid reinforcement plate 92 is preferably permanently mounted by means of welding, heavy duty bolts, or the like to the hull of boat 15. Reinforcement plate 92 extends from the floor of boat 15 up over the rim of the hull to providing an undergirding for clamp 38.

Control system 34 comprises a pair of cooperating foot pedals 44 linked by a pair of flexible control cables 54A and 54B to the paddle assembly 24. The control cables are trained over front guide pulleys 48 and rear guide pulleys 50. Pulleys 48 are mounted at the sides of the boat rear by rigid legs 53. The cables terminate at one end at a guide donut assembly 56 which controls paddle assembly 24, and their opposite ends are connected to the pedals 44. Cables 54A, 54B are preferably removably attached to the base of pedal plates 113 by means of an eyelet hook or the like (not shown). Foot pressure transmitted to the paddle system 24 from cables 54A and 54B controls the paddle. Blade pitch changes whenever the pressure in one cable is greater than the other (i.e. immediately after the actuation of a particular pedal commensurate with a foot stroke.)

Pulleys 50 are preferably positioned approximately even with the fisherman's side and suspended from turnbuckles 117 associated with the sides 63 of the boat. Turnbuckles 117 may be conveniently adjusted to remove slack and properly tension cables 54A, 54B for smooth operation. Pulleys 48 are supported upon a rigid, elongated support arm 53 associated with control system 34 and maintained such that the cable ends extend toward the blade system in substantial axial alignment, occupying a line parallel with and spaced apart from the transom 13. Arm 53 is operatively joined at its outer ends to guide pulleys 48.

Foot pedals 44 are preferably suspended for rotation about a rigid crossbar 59 positioned near the operator's feet 18 and semi-permanently secured between the sides 63 of the boat 15 by braces 61. The pedals 44 are linked to the steering assembly by a pair of cooperating cables 54A, 54B preferably comprising equal lengths of aircraft stranded steel covered with a waterproof jacket of nylon or similar material. Each foot pedal 44 comprises a rigid pedal plate 113 swiveled to an L-shaped crank 118 which upwardly terminates in a tubular crank bearing 123 mounted on crossbar 59.

Each crank bearing 123 is slidably, rotatably fitted to crossbar 59 at a desired position comfortable to fisherman 11. When foot pressure is applied, bearings 123 tend to move outwardly towards the sides of the boat. They are laterally held in position by an adjoining collar and set screw assembly 125 which limits bearing travel along shaft 59. Assemblies 125 may be loosened to permit slidable adjustment of the cranks and pedals longitudinally along crossbar 59. Because the foot pedals 44 are suspended upon crossbar 59 at a distance well above the floor of the boat and spaced apart from the sides 63 of the boat, the operation of the assembly 10 is virtually silent. Thus there is less likelihood that fish in the area will be frightened away.

With primary reference now to FIG. 5, paddle assembly 24 comprises an upper portion, generally designated by the reference numeral 68, and a lower blade unit 23 which may be removed. Lower unit 23 preferably comprises a rigid, generally planar, wooden board 80 made from a conventional oar and having a rounded base and a narrow, pointed top 83. Shaft 28 is mated to blade 80. Blade top 83 is permanently secured to a rigid, preferably metallic cap 85 extending from shaft 28 by a multiplicity of rivets 88. Shaft 28 has a larger diameter upper end 93 which terminates in a collar 95 having an interior 96 generally in the form of an inverted truncated cone. It is mated to a similarly profiled bearing fitting 197 at the bottom of upper unit 68. When fitting 197 is mated to collar 95, orifices 98A and 98B will align, so that a suitable cotter pin may secure the two together to secure the blade 80 to the apparatus. Preferably a slot 99 is defined across fitting 95 to provide clearance for an additional fastener pin 97.

Figure 5A:
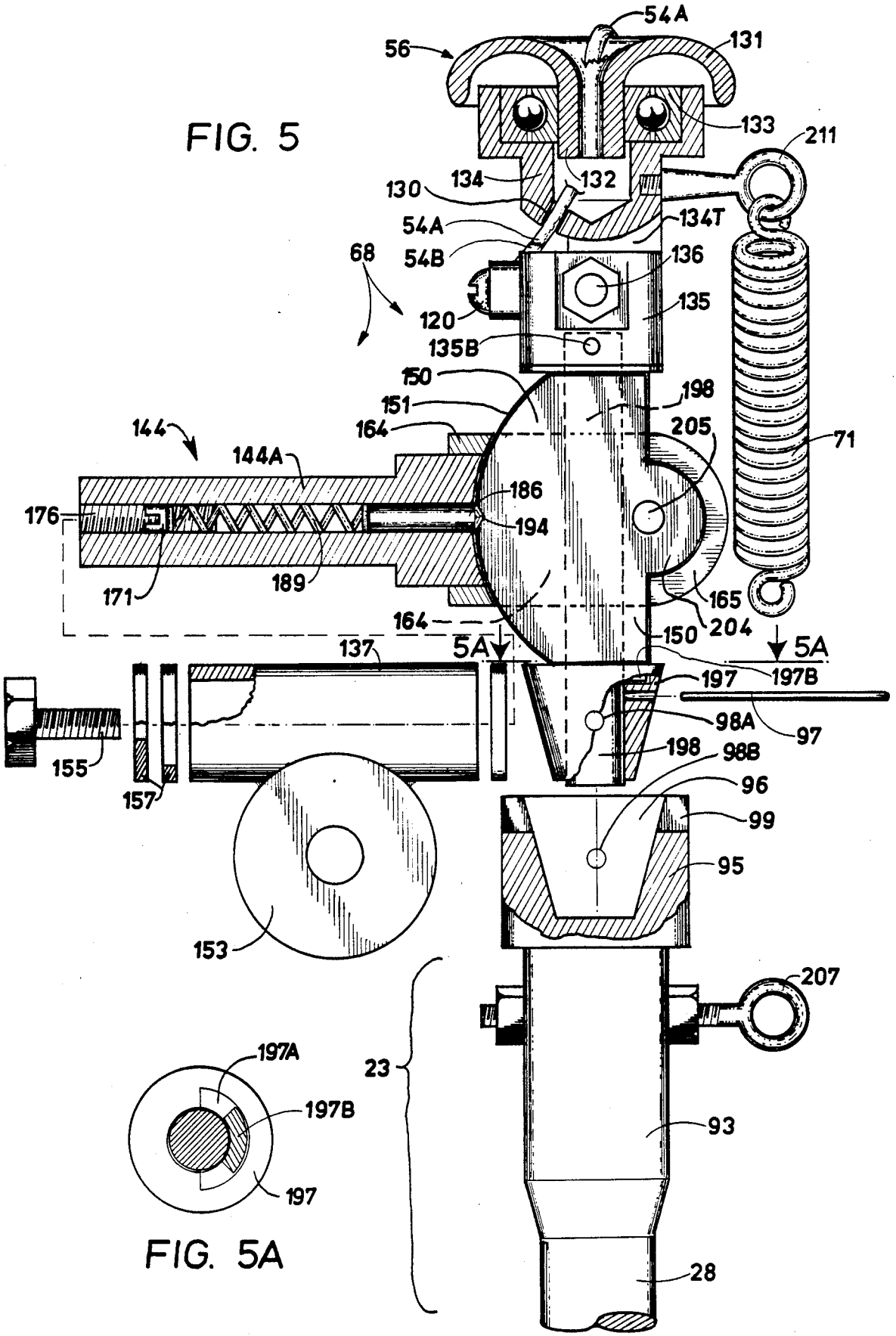
FIG. 5A is a partial fragmentary sectional view taken generally along line 5A—5A of FIG. 5.

In FIG. 5A, it is seen that an arcuate slot 197A in bearing 197 registers with a follower 197B projecting downwardly from cam 150. Relative rotation between the cam and the blade is thus limited to approximately ninety degrees, so that during the first motion the blade can be rotated between attack pitches of plus and minus forty five degrees relative to the longitudinal axis of the boat.

A control donut 56 is disposed at the top of the upper unit 68 of the paddle assembly 24. The donut preferably comprises a donut shaped head 131 having a central stem 132 coupled to annular bearing 133, which is concentrically mounted within the receptive annulus of lower donut collar 134. A flat, generally rectangular tab 134T projects downwardly from collar 134 towards bearing sleeve 135 and is pivotally coupled thereto with a screw 136.

Thus donut head 131 and collar 134 can pivot about screw 136 relative to sleeve 135 (i.e. to the left or to the right as viewed in FIG. 5). In addition, head 131 is rotatable relative to collar 134 because of roller bearing 133. Control cables 54A, 54B pass through the center 55 (FIGS. 6, 7) of donut head 131 through side orifice 130 in collar 134 and are terminated by set screw assembly 120. Sleeve 135 mounts a downwardly projecting shaft 198 which is concentrically mated to it with a pin 135B.

As best viewed in FIG. 5, a recoil spring 71 extends lengthwise from screw eyelet 207 secured to blade shaft end 93 and is adapted to be coupled to screw eyelet 211 in collar 134. Spring 71 normally biases cable guide donut 56 to the right (as viewed in FIG. 5). When total tension applied by cables 54A, 54B by manipulation of foot pedals 44 exceeds the tension in spring 71, the donut flips over, as will be seen by comparing FIGS. 6 and 7.

The upper unit 68 of the paddle assembly 24 also comprises a cam 150 which is disposed between sleeve 135 and fitting 197. Cam 150 is generally D-shaped, and its outer, arcuate cam surface 151 projects towards the boat. The cam is penetrated by rotatable shaft 198 which extends between the doughnut assembly and the lower fitting 197. The cam facilitates the third motion mentioned above, enabling deflection of the paddle 24 to prevent the paddle from becoming damaged or dislodged from its mount 38 when it strikes an unseen submerged object such as a tree stump, fence post, or the like. After such a strike occurs, the cam apparatus permits the automatic return of the paddle to an upright position for continued normal operation.

The cam is grasped within the fork of a mounting bracket 164 which mounts the entire paddle assembly to the C-clamp 38 secured to the boat transom. Bracket 164 has similar rigid sides extending on opposite sides of the cam, and their rounded ends 165 are suitably apertured to register with orifice 205 in cam projection 204. A nut and bolt assembly 168 penetrates orifice 205 in cam body 150 (FIG. 5.) to pivotally couple cam 150 and bracket 164. Orifice 205 establishes the pivot point enabling the third movement discussed above.

Figure 3:
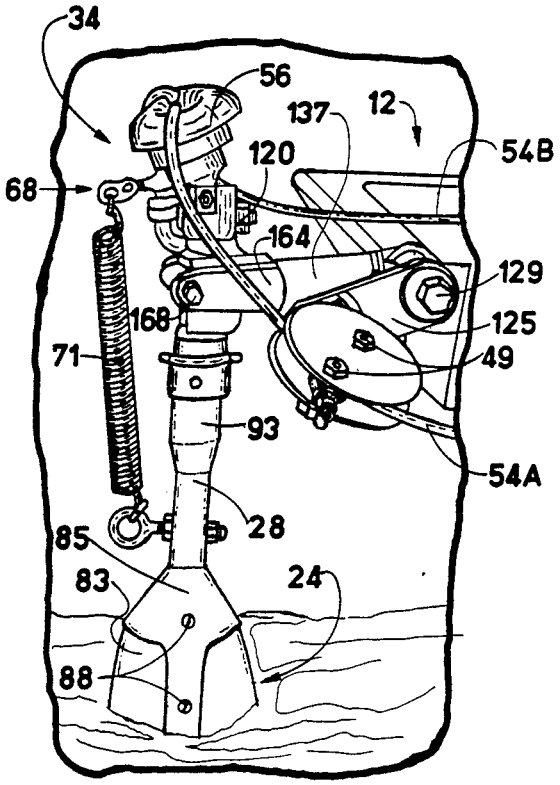
FIG. 3 is a fragmentary, enlarged, side elevational view thereof.

Cam bracket 164 is coupled to rigid, cylindrical shaft 144 adapted to be rotatably received within a fixed sleeve 137. Sleeve 137 comprises an elongated tube having an integral mounting tab 153, and as best seen in FIG. 3, sleeve 137 is coupled to rigid brackets 125 which are pivoted with bolt 129 to C-clamp 38. Sleeve 137 is pivoted between brackets 125 (FIG. 3) via captured lower tab 153. Reduced diameter shaft end 144A rotatably received within sleeve 137 is secured by a conventional stud 155, and ease of rotation is maintained by the washers 157.

An interior bore 176 within shaft portion 144A coaxially receives spike 186 which is biased by an internal spring 189. Spike 186 includes a rigid tip which fits within a corresponding angular channel 194 defined within cam body 150. Bore 176 further receives an insert 171 which can be adjusted to vary spring pressure. Spike 186 is thus biased against cam surface 150, and its outer tip 194 will normally seat within a suitable groove formed in the cam surface 151.

OPERATION

In operation, the assembly 10 permits a fisherman to maneuver the watercraft forward or backward through the water in response to manipulation of the foot pedals 44, while the fisherman's hands remain free for operation of other fishing or sporting equipment. For optimum control and proper operation, it may be necessary for the fisherman to "set up" the assembly by assuring that the paddle is fully upright or vertical positioned and that tension is evenly distributed between the cables by simple adjustment of turnbuckles 117.

Figure 6:
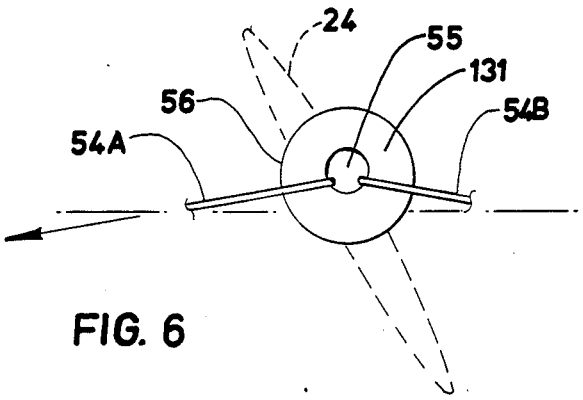
FIG. 6 is a fragmentary diagrammatic view looking down on the donut, with portions thereof broken away for clarity or omitted for brevity; and, FIG. 7 is a diagrammatic view similar to FIG. 6 showing a moved position, with portions thereof broken away for clarity or omitted for brevity
Figure 7:
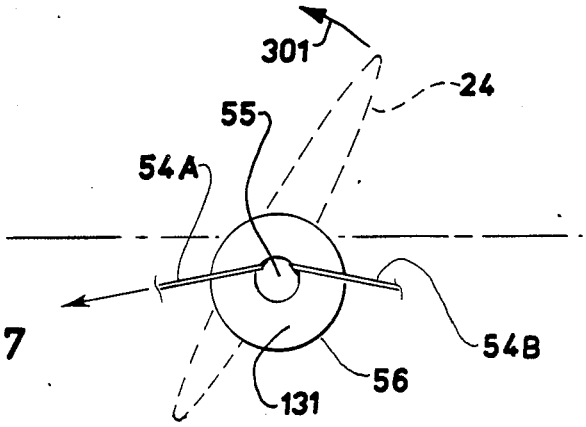

To effectuate forward movement of the watercraft, the fisherman simply applies moderate, even pressure to each pedal during the power strokes. With the first application of pedal pressure, the first blade motion commences, and the blade rotates axially a limited amount until the follower is stopped (see FIG. 5A) to assume a desired pitch. With reference to FIGS. 6 and 7, if cable 54A is tensioned first, the blade rotates in the first motion until the follower limits travel (FIG. 5A) and then pressure experienced subsequently effectuates the second motion. The blade is then arced through the water at a preestablished pitch to effectuate propulsion.

Figure 4:
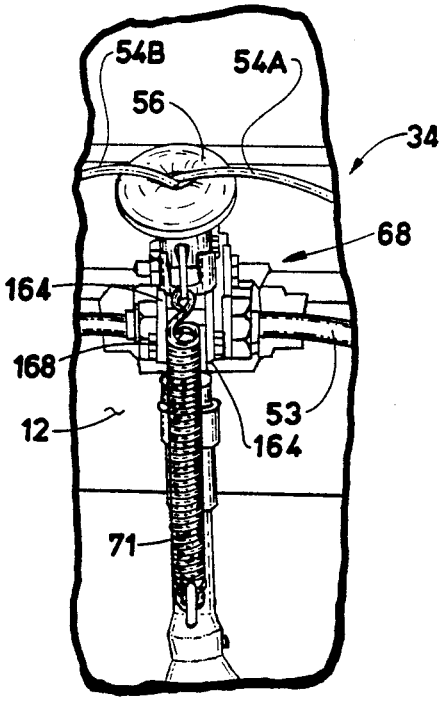
FIG. 4 is a fragmentary, enlarged, rear elevational view thereof.

Boat propulsion is thus effectuated by the propeller-like action when the paddle swings in its limited arc through the water when pressure is applied by the cables (i.e. the second motion). The direction of boat travel is first determined by the position of doughnut 56, since its position will determine the paddle twist direction (i.e. the pitch) when a given cable force is applied. In other words, shifting of the donut reverses the torsional displacement of the paddle which a given cable tension will produce. A comparison of FIGS. 6 and 7 clarifies this function. Spring 71 maintains the doughnut in a position where the cables (i.e. FIG. 4) are tilted over the axis of the paddle 28.

When the total pressure supplied concurrently by both cables is sufficient to overcome bias from spring 71, the donut flips over from the position in FIG. 7 to the position of FIG. 6. Thereafter when the same cable is tensioned, since its has in effect been moved across the center 55 of the donut, its torsional forces will now rotate the blade in the opposite direction from that indicated by arrow 301 in FIG. 7. Then, when torsional travel is limited (FIG. 5A) the paddle is again pivoted in a generally semi-circular arc through the water. This time, however, the pitch has been changed during the first motion, and the second motion now propels in an opposite direction from before. If both pedals are pushed in at once, doughnut 56 "flips over" across the center line of paddle 28 in response to the combined translational forces exerted by both cables against pressure from spring 71.

To move in a constant direction with both swings of the arc, blade pitch must be reversed in each half cycle. The paddle is pivoted so that it twists immediately prior to being deflected in its arc, and it will automatically twist to an opposite deflection just before pressure on the opposite pedal moves the arc in the opposite direction. In the forward mode both pedals must be pushed at once to deflect doughnut 56 over center (i.e. against tension from spring 71). When this occurs, it will be apparent that when cable 44, for example, is tensioned the paddle will twist in a direction opposite from the direction of twist when the doughnut was flipped over. Continued pressure on the cable will still deflect the paddle in the same arc through the water as before, but because of reversing in the twisting action caused by the deflection of the doughnut 56, each power stroke will now force the boat in the opposite direction.

It will be appreciated that a great deal of effort is not required for routine operation of the device, since a full seven-inch foot stroke will rotate the paddle one full forty-five degree stroke. A full stroke will propel the boat at a relatively high speed. For operation at normal trolling speeds or low speeds for operation in densely vegetated waters, it is necessary to rotate the pedals alternatively only two to three inches.

When the paddle strikes an unseen submerged object, it will automatically be urged to tilt to ride over the object. When resistance from the object is experienced, the cam will rotate about bolt 168 until the rigid spike follower stud spike 186 within sleeve 137 becomes disengaged from a transverse channel defined within the cam body 150. Thus the paddle is permitted to freely tilt and "ride over" the submerged object without breaking or becoming damaged. As the paddle tilts forward to ride over the object, spring 71 is greatly expanded. Once the object is safely avoided, tension in spring 71 will be released, and the spring will retract, automatically urging the paddle to return to its upright, substantially vertical position. If complete reset does not occur, then cable tension from both pedals will assist in returning the paddle assembly to the normally vertically upright position depicted in FIG. 5.

If extreme tilt is experienced, the paddle may not easily return to its upright position. However, by creating tension on one of the cables by manipulation of its corresponding foot pedal and thus employing the force of water resistance against the paddle, the fisherman can easily "pull" the paddle back into position. In the prior embodiment of the invention, the fisherman would have to leave the seated position and stand in the rear of the boat to manually pull the paddle back into a vertical orientation. In applying such force, the fisherman might easily lose his balance and topple out of the boat into the water. Also, if the lightweight boat were already loaded, exerting additional weight at the rear of the boat might allow water to seep in. If the tension on spring 189 is too light the spike will not adequately engage the channel and the fisherman will experience limited control during normal forward or backward travel, due to excessive "play" in the paddle in its upright position. Then insert 171 (FIG. 5) must be adjusted to vary spring tension.

When it is desired to raise the paddle up out of the water in order to position the paddle for trailering or for use of a power motor or similar alternative propulsion device, the paddle may be pulled upwardly ninety degrees and set to rest on the top of guide pulleys 48.

Thus forward and reverse propulsion of the boat is accomplished by lateral sweep or "sculling" of a paddle positioned generally parallel to the transom of the boat. The arc of rotation or "sweeping" of the paddle is not the only paddle movement. The paddle also torsionally rotates each time it is tensioned by a cable, to assume a new pitch. The motion of the paddle in water is analogous to the motion of an airplane prop in the air. However, it moves in arcs approximating a half of a circle, and it constantly reverses direction as alternating pedals are pushed. Thus it is twisted to maintain the correct "power thrust" each time.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A boat propulsion system for foot operation by a fisherman to maneuver a boat through a body of water, said boat having a longitudinal axis, said propulsion system comprising:

mounting means for securing said propulsion system upon a portion of said boat;

paddle means extending into the water for propelling said boat through said body of water;

foot-powered pedal means for actuating said paddle means from a position within the boat;

cable means interconnecting said pedal means with said paddle means for operating same cam means for releasably operatively mounting said paddle means to said mounting means;

means for facilitating torsional rotation of said paddle means relative to said cam means to reverse the pitch of said paddle means in initial response to differential cable tension thereby effectuating a first motion twisting said paddle means to achieve a proper pitch;

donut means for operatively coupling said cable means to said paddle means, said donut means deflectable between forward and reverse positions to reverse the direction of paddle rotation in response to torsional forces;

means for facilitating rotation of said paddle means relative to said boat in response to differential cable tension to facilitate a second motion wherein said paddle means is periodically arced through the water in a plane generally perpendicular to the longitudinal axis of said boat to effectuate propulsion; and, said mounting means, said cam means displaceable from a normally fixed position in response to contact of said paddle means with an underwater obstacle to effectuate a third motion allowing said paddle means to move in an arc occupying a plane substantially coincident with or parallel to said boat longitudinal axis.

2. The boat propulsion system as defined in claim 1 wherein said propulsion system comprises adjustable clamp means for securing said assembly to said boat; and, pulley means associated with said clamp means for guiding said cable means into said donut means.

3. The propulsion system as defined in claim 2 wherein said cam means comprises a rigid cam body having a cam surface, a notch defined in said cam surface, and said propulsion system comprises a follower stud biased toward said cam surface for normally engaging said notch to maintain said paddle means in a normally substantially vertical operative position.

4. The propulsion system as defined in claim 3 wherein said pedal means comprises a pair of foot pedals permanently mounted for rotation upon a rigid crossbar extending transversely across said boat.

5. The propulsion system as defined in claim 4 wherein said cable means comprises two cooperating, elongated lengths of flexible, waterproof cable, and turnbuckle means for facilitating selective adjustment of the cable tension to align said paddle means.

6. The propulsion system as defined in claim 5 wherein said donut means is pivotally mounted relative to said cam means.

7. The boat propulsion system as defined in claim 6 wherein said propulsion system comprises rigid plate means for reinforcing the portion of said boat against warping.

8. A boat propulsion system for foot operation by a fisherman to maneuver a boat through a body of water, said boat having a longitudinal axis, said propulsion system comprising:

mounting means for securing said propulsion system upon a portion of said boat;

paddle means extending into the water for propelling said boat through said body of water;

foot-powered pedal means for actuating said paddle means from a position within the boat;

cable means interconnecting said pedal means with said paddle means for operating same;

means for facilitating initial torsional rotation of said paddle means to establish the pitch of said paddle means in initial response to differential cable tension thereby effectuating a first motion twisting said paddle means to achieve a proper pitch;

donut means for operatively coupling said cable means to said paddle means, said donut means deflectable between forward and reverse positions in response to predetermined total cable force to reverse the direction of paddle axial rotation in response to initial cable forces;

cam means for releasably operatively mounting said paddle means to said mounting means, said cam means displaceable from a normally fixed position in response to contact of said paddle means with an underwater obstacle and thereby establishing a second motion, said cam means comprising a rigid cam body, a notch defined in said cam body, and a follower stud biased toward said cam body for normally engaging said notch to maintain said paddle means in a generally vertically upright operative position;

means interconnecting said paddle means with said cam means for facilitating twisting of said paddle means relative to said cam means to reverse the pitch of said paddle means;

donut means for operatively coupling said cable means to said cam means, said donut means pivotally mounted relative to said cam means and deflectable between forward and reverse positions to reverse the direction of boat travel; and, sleeve means for facilitating rotation of said paddle means relative to said boat in response to differential cable tension to facilitate a third motion effectuating propulsion.

9. The boat propulsion system as defined in claim 8 wherein said propulsion system comprises adjustable clamp means for securing said propulsion system to said boat; and pulley means associated with said clamp means for guiding said cable means into said donut means and spring means for normally biasing said donut means to a predetermined position establishing a predetermined blade pitch.

10. The propulsion system as defined in claim 9 wherein said cam means comprises a rigid cam body having a cam surface, a notch defined in said cam surface, and said propulsion system comprises a follower stud biased toward said cam surface for normally engaging said notch to maintain said paddle means in a normally substantially vertical operative position.

11. The propulsion system as defined in claim 10 wherein said pedal means comprises a pair of foot pedals permanently mounted for rotation upon a rigid crossbar extending transversely across said boat.

12. The propulsion system as defined in claim 11 wherein said cable means comprises two cooperating, elongated lengths of flexible, waterproof cable, and turnbuckle means for facilitating selective adjustment of the cable tension to align said paddle means.

13. The propulsion system as defined in claim 12 including means for limiting said paddle means axial torsional rotation.

* * * * *